United States Patent [19]

Claydon et al.

[11] Patent Number: 4,620,683

[45] Date of Patent: Nov. 4, 1986

[54] APPARATUS FOR SUPPORTING A FLEXIBLE CONTAINER IN AN OPEN POSITION

[75] Inventors: Susan D. Claydon; Howard F. Claydon, both of Boulder, Colo.

[73] Assignee: Elmer Ferdon, Berthoud, Colo.

[21] Appl. No.: 677,498

[22] Filed: Dec. 3, 1984

[51] Int. Cl.[4] ..... F16M 11/38

[52] U.S. Cl. ..... 248/97; D34/6; 248/99; 248/431

[58] Field of Search ..... 248/97, 95, 99, 100, 248/101, 98, 96, 164, 431; 232/43.1, 43.2; D34/6; 297/42, 45, 56; 108/118

[56] References Cited

U.S. PATENT DOCUMENTS

| | | | |
|---|---|---|---|
| 688,238 | 12/1901 | Davis | 248/97 |
| 748,387 | 12/1903 | Lilly | 248/97 |
| 1,542,164 | 6/1925 | Nelson | 248/97 |
| 3,659,816 | 5/1972 | Wilson | 248/97 |
| 3,893,648 | 7/1975 | Gilbert | 248/97 |
| 4,281,814 | 8/1981 | Verwey | 248/97 |
| 4,318,520 | 3/1982 | Walker | 248/97 |
| 4,540,308 | 9/1985 | Colby | 248/431 X |

*Primary Examiner*—Ramon O. Ramirez

*Attorney, Agent, or Firm*—Joseph H. Roediger

[57] ABSTRACT

A support structure for flexible containers, such as plastic shopping bags, which is both collapsible for storage and readily assembled to support the flexible container in an open position for the placement of items therein, especially during reuse of the container.

5 Claims, 5 Drawing Figures

APPARATUS FOR SUPPORTING A FLEXIBLE CONTAINER IN AN OPEN POSITION

BACKGROUND OF THE INVENTION

This invention relates to a supporting structure for maintaining a flexible container such as a plastic shopping bag in an upright open position for the placement of articles to be transported therein. The flexible container is removably secured to the supporting structure to permit the lifting of the container when filled for transport.

The economic pressures of modern retailing have initiated a move towards the replacement of heavy paper shopping bags for the transport of purchased articles to the use of thin film plastic bags. The plastic bags are significantly lower in cost, easier to store prior to use and can be manufactured in a variety of colors to accentuate the trade names of the establishment providing the carriers.

The major disadvantage associated with the use of this type of container is its inability to be self-supporting when in an upright position both during the time that it is being filled at the store and later when a secondary use is being made by the consumer at another location. For years, the brown paper bag has provided the general public with a convenient self-supporting reuseable container, and the substitution therefor of the non-rigid plastic container has met with growing dissatisfaction on the part of the consuming public to the point where it is felt that consumers are altering their purchasing patterns in favor of stores continuing to provide the traditional brown paper container for the transport of purchased articles.

The present invention is directed to the provision of apparatus for supporting the thin film plastic container in an upright and open position to facilitate both loading and unloading during initial use or for subsequent usage at a new location. One objective of the invention is to provide a supporting structure which can be readily assembled and disassembled for storage.

Further, the present invention when in the disassembled state is compact for storage as a relatively thin planar collection of piece parts when compared with the assembled supporting structure. Another object of the invention is to provide a low cost support apparatus having few individual parts to provide simplified assembly and thereby promote acceptance by the public.

SUMMARY OF THE INVENTION

This invention relates to apparatus for supporting flexible containers, typically thin film plastic bags of the type provided today with increasing frequency at supermarkets and other retail establishments.

The support apparatus includes first and second elevating legs, each of which is provided with first and second ends. In the assembled state, the legs are angularly disposed with respect to each other so as to intersect in a region approximately midway between the first and second ends of the legs. Means for interconnecting the first and second legs in the region of intersection are provided. Also, each elevating leg is provided with a support means affixed to its first end which contacts the support surface and maintains the apparatus in an upright position.

First and second horizontal extensions are affixed to the second ends of the first and second elevating legs respectively so as to extend outwardly therefrom substantially parallel to the support means. Thus, an area is provided between the extensions to receive a flexible container being filled.

Typically, the flexible containers include handle portions which merely are strips of plastic material separated from the body of the container by a cut-out region. To provide a support for receiving the flexible container, engaging means are affixed to each of the extensions. Each engaging means includes an upwardly extending flange for insertion in the cut-out region below the handle of the flexible container. In a preferred embodiment, the engaging means includes a pair of spaced upwardly extending flanges which permit the user to place his hand therebetween while inserting it through the cut-out region in the flexible container prior to removal and transport thereof.

Further features and advantages of the invention will become more readily apparent from the following detailed description of a specific embodiment of the invention when taken in conjunction with the accompanying drawings.

DESCRIPTION OF THE PREFERRED EMBODIMENT

Figure 1:
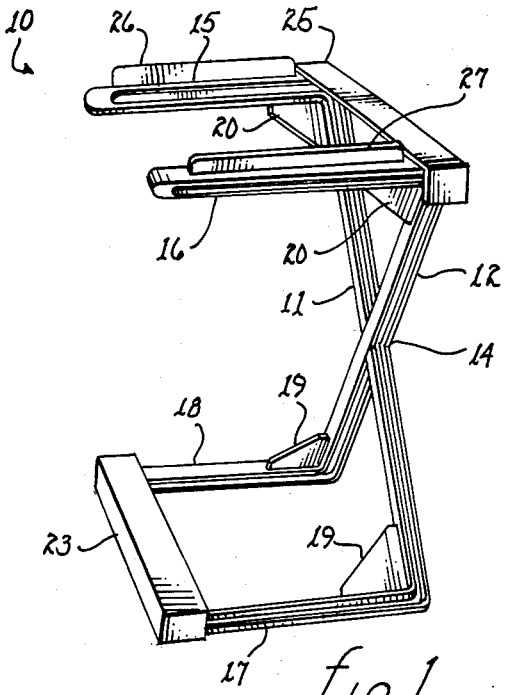
FIG. 1 is a perspective view of one embodiment of the invention with both retaining means shown separated from the assemblage.

Referring now to FIG. 1, a preferred embodiment 10 of the collapsible support structure for a flexible container is shown including first and second elevating legs 11 and 12 which are angularly disposed to intersect in a region midway between their ends.

The interconnection 14 establishes the angle between elevating legs and is seen in the preferred embodiment of FIG. 1 as 45°.

The first or lower ends of the elevating legs 11 and 12 are provided with corresponsing first and second support means 17 and 18 each of which extends outwardly away from its leg to engage the basal or support surface.

In order to impart rigidity to the structure, reinforcing tabs 19 are provided in the preferred embodiment between the elevating legs and the support means.

Further, the opposing ends of the first and second elevating legs are provided with first and second horizontal extensions 15 and 16 respectively, extending outwardly therefrom. The extensions are substantially horizontal in registration with the underlying support means and also provided with reinforcing tabs 20 at the juncture between the extension and the elevating leg to provide support for the structure.

As shown, the forward ends of the elevating legs are each received within the basal retaining means 23. The retaining means 23 as shown in FIG. 1 is a parallelepiped with two sides open to facilitate assembly by the user. In similar manner, the second ends of elevating legs 11 and 12 are received in the upper retaining means 25 similar in shape to retaining means 23.

Other shapes may be utilized if desired; however for ease of manufacture and assembly, the preferred embodiments use interchangeable retaining means.

The upper surface of the extensions 15, 16 is provided with engaging means 26, 27 each of which comprises a pair of spaced upwardly extending flanges.

Figure 2:
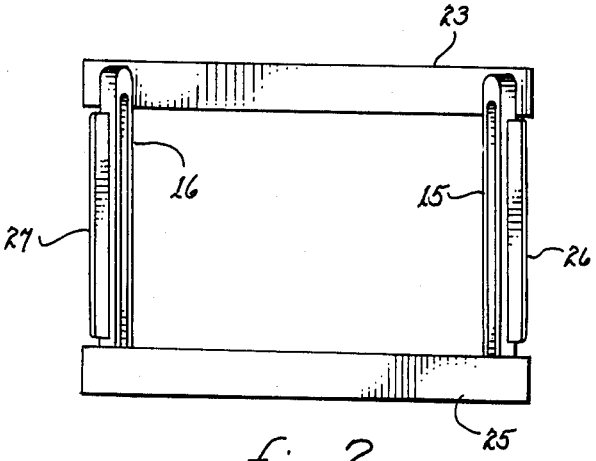
FIG. 2 is a top view of the embodiment of FIG. 1 with the retaining means in place.
Figure 3:
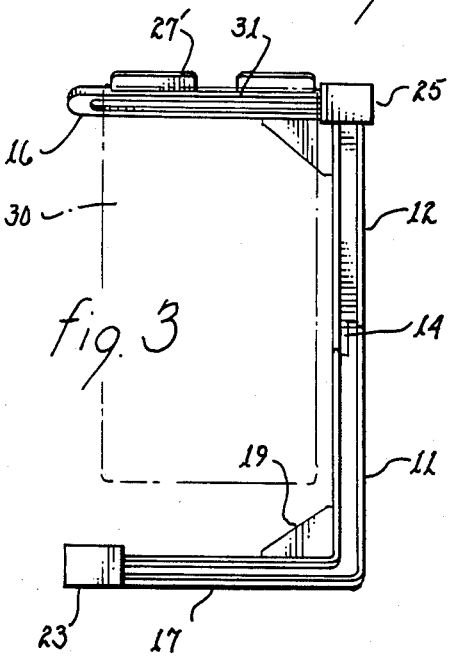
FIG. 3 is a side view of the embodiment of FIG. 2 with a flexible container mounted thereon.
Figure 4:
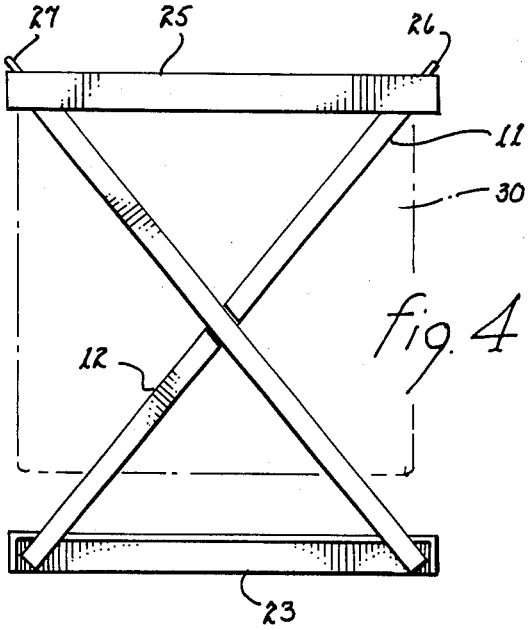
FIG. 4 is a back view of the embodiment shown in FIG. 3

In the embodiment of FIG. 3, the flanges 27' are spaced apart by a distance which is approximately equal to the cut-out portion of the flexible container 30 intended to define the handle thereof. Also, the support structure is shown in the top view of FIG. 2 with the upper retaining means 25 in position over the upper rear surface of the elevating legs 11 and 12. The side view of FIG. 3 shows a flexible container 30, typically formed of thin film plastic, having its handle portion 31 placed about the flanges 27' on the top surface of the extension. By providing spaced flange pairs, the removal of the loaded flexible container is facilitated.

Figure 5:
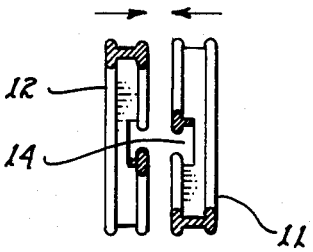
FIG. 5 is a detailed view of the interconnection between legs in the embodiment of FIG. 1.

The interconnection region between the elevating legs 11 and 12 is shown as intersection 14 in FIG. 3 wherein elevating leg 12 extends upwardly from the intersection in the side view while elevating leg 11 extends downwardly to its support means 17. The interconnection is shown in greater detail in the exploded view of FIG. 5 wherein the notches formed in the adjacent surfaces of the elevating legs can be seen. The notches provide for simplified assembly as well as compensating for the compressive forces resulting from a loaded bag 30 being placed on the flanges and in position between the extensions 15 and 16.

The support structure is a relatively lightweight assemblage of but four parts, preferably injection molded from plastic. When the retaining means 23 and 25 are withdrawn from the elevating legs, the legs can be readily separated at the interconnection 14 to provide for storage in areas of limited space. It should be noted that the four parts can be stored as a planar assemblage. Each combination of elevating leg with its support means and extension attached thereto is formed as an integral unit and preferably ridges are formed thereon to provide a central core of reduced thickness. This enhances the load bearing capability of the structure while reducing the amount of material required. In manufacture, the structure, made of molded plastic, is inexpensive to fabricate, thereby appealing to the second user of the container. By reducing the quantity of materials as shown in the preferred embodiment, the per unit cost is reduced. However, in other embodiments, a single engaging flange of increased strength can be provided along each of the upper surfaces of the extensions. This embodiment contemplates heavier loading of the flexible container contained therebetween.

Further reduction in per unit material cost is obtained by providing the retaining means 23 and 25 as hollow parallelepipeds as shown and by removal of the central portions of the flanges 27. As an alternative, solid retaining means having holes therein to engage pins formed on the adjacent surfaces the elevating legs can be used for structural rigidity. Again, an embodiment of this type increases the mass of material used since the retaining means is a solid member.

While the above description has referred to a specific embodiment of the invention as shown, it is to be recognized that many variations and modifications may be made therein without departing from the scope of the invention as set forth in the accompanying claims.

What is claimed is:

1. Apparatus for supporting flexible containers of the type having spaced hand-grippable openings in their upper peripheral region, said apparatus comprising:

(a) first and second elevating legs each having first and second ends and containing a receiving notch located therebetween, said legs mutually receiving said notches in a region between said first and second ends and being angularly disposed in a fixed position;

(b) first and second support means affixed to the first end of the corresponding elevating leg and extending outwardly therefrom for engaging a support surface;

(c) basal retaining means connected between said first and second support means for limiting lateral movement therebetween;

(d) first and second spaced parallel extensions affixed to the second ends of the corresponding elevating legs and extending outwardly therefrom in the direction of the support means, said extensions having an upper surface; and (e) first and second engaging means affixed on the upper surface of the corresponding one of said extensions for removably receiving the hand-grippable portions of a flexible container located therebetween and detachably depending therefrom.

2. Apparatus in accordance with claim 1 wherein said engaging means comprises first and second upwardly extending flanges located on the upper surface of said first and second extensions respectively and extending parallel therealong for removably receiving handles of the flexible container and maintaining said container in an open position.

3. Apparatus in accordance with claim 2 wherein said flanges are positioned to extend upwardly parallel to the elevating legs.

4. Apparatus in accordance with claim 3 further comprising upper retaining means connected to said first and second elevating legs proximate to the second ends thereof for limiting relative movement therebetween.

5. Apparatus in accordance with claim 4 wherein said first and second elevating legs, first and second support means, first and second extensions and first and second engaging means are formed as first and second members respectively, said members being detachable at the notches to permit disassembly.

* * * * *